US008336244B2

(12) United States Patent
Peterson et al.

(10) Patent No.: US 8,336,244 B2
(45) Date of Patent: Dec. 25, 2012

(54) MOUNTING BRACKETS FOR ELECTRO-OPTICS DEVICES AND OTHER FIREARM ACCESSORIES

(75) Inventors: Morris Peterson, Earlysville, VA (US); Matthew Peterson, Crozet, VA (US); Charles Robert Overbey, Jr., Deland, FL (US); Gary Vance, Bristol, VA (US)

(73) Assignee: Ashbury International Group, INc., Ruckersville, VA (US)

( * ) Notice: Subject to any disclaimer, the term of this patent is extended or adjusted under 35 U.S.C. 154(b) by 259 days.

(21) Appl. No.: 12/234,527

(22) Filed: Sep. 19, 2008

(65) Prior Publication Data

US 2009/0101776 A1 Apr. 23, 2009

Related U.S. Application Data

(60) Provisional application No. 60/973,461, filed on Sep. 19, 2007.

(51) Int. Cl.
*F41C 27/00* (2006.01)

(52) U.S. Cl. ..... 42/90; 42/124

(58) Field of Classification Search ..... 42/72, 85, 42/90, 124, 127; 248/226.11, 231.41, 231.61, 248/231.85

See application file for complete search history.

(56) References Cited

U.S. PATENT DOCUMENTS

| | | | | |
|---|---|---|---|---|
| D253,545 | S | 11/1979 | Chesnut | |
| D256,830 | S | 9/1980 | Bechtel | |
| D265,920 | S | 8/1982 | Bechtel | |
| D274,540 | S | 7/1984 | Bechtel | |
| 4,837,961 | A * | 6/1989 | Keenan | 42/72 |
| 4,878,307 | A * | 11/1989 | Singletary | 42/124 |
| 5,606,818 | A * | 3/1997 | Hardee | 42/124 |
| 5,941,006 | A * | 8/1999 | Horton | 42/124 |
| 5,941,489 | A * | 8/1999 | Fanelli et al. | 248/298.1 |
| 6,598,331 | B1 * | 7/2003 | Thibodeaux | 42/111 |
| 6,637,144 | B2 * | 10/2003 | Nelson et al. | 42/120 |
| 6,775,942 | B2 * | 8/2004 | Compton | 42/85 |
| 6,792,711 | B2 * | 9/2004 | Battaglia | 42/114 |
| 6,854,206 | B2 * | 2/2005 | Oz | 42/124 |
| 7,188,978 | B2 * | 3/2007 | Sharrah et al. | 362/396 |
| 7,481,016 | B2 | 1/2009 | Gonzalez | |
| D598,971 | S | 8/2009 | Peterson et al. | |
| 2003/0230022 | A1 * | 12/2003 | Battaglia | 42/111 |
| 2004/0000083 | A1 * | 1/2004 | Grant, Jr. | 42/112 |
| 2006/0288626 | A1 * | 12/2006 | Kim | 42/73 |
| 2007/0199225 | A1 * | 8/2007 | Haugen | 42/85 |
| 2007/0289192 | A1 * | 12/2007 | Whaley | 42/90 |
| 2009/0077855 | A1 * | 3/2009 | Pritchett | 42/90 |

* cited by examiner

*Primary Examiner* — Gabriel Klein
(74) *Attorney, Agent, or Firm* — Troutman Sanders LLP; Robert R. Elliott, Jr.

(57) ABSTRACT

Mounting brackets for use in attaching accessory devices to firearms are provided. Some embodiments can be configured as detachable and can comprise multiple transverse members disposed between two connection members and an attachment member. Connection members can be configured for attachment to an exterior firearm surface, such as along a top surface of a fire arm. The second generally parallel member can be spaced apart from the connection members and can comprise an outer surface, which can be configured as Picatinny rail for carrying devices. Transverse members can be disposed between and coupled to the parallel members, and the number of transverse members can. The transverse members can define openings enabling including structural strength, low weight, and compact, sleek design. The transverse members can be angled relative to the parallel members to provide structural and energy absorption features. Other aspects, features, and embodiments are also claimed and described herein.

27 Claims, 10 Drawing Sheets

MOUNTING BRACKETS FOR ELECTRO-OPTICS DEVICES AND OTHER FIREARM ACCESSORIES

CROSS REFERENCE TO RELATED APPLICATION & PRIORITY CLAIM

This patent application claims priority to and the benefit of U.S. Provisional Application No. 60/973,461, entitled "Mounting Bracket for Electro-Optic Devices for Firearms and Other Equipment," filed 19 Sep. 2007, which is incorporated herein by reference in its entirety as if set forth full below.

TECHNICAL FIELD

The various embodiments of the present invention relate generally to firearms, and more particularly, to mounting brackets used to carry or mount various accessory devices, such as electro-optic and lighting devices, for use with various weapons platforms in various environments.

BACKGROUND

Usage of modern firearms, particularly those employed in tactical competition, law enforcement, and military communities, sometimes includes also using various accessories. These accessories may include optical scopes, rangefinders, flashlights, lasers, less-lethal devices and various other equipment as desired. Accessories can vary greatly depending on the specific mission, activities, or user desires. Some accessory devices can include precision optics and electronics that must be securely mounted to the firearm so that these accessories can be effectively employed in competitive, tactical, law enforcement, and combat environments.

To provide a universal and secure method for mounting accessories some use a rail mounting system called the Picatinny rail (also referred to as the 1913 spec Picatinny rail standard). The Picatinny rail provides a uniform mounting system for tactical and military weapons. Widespread use of the Picatinny rail on weapons platforms has led to an increase number of tactical accessories designed for use with a Picatinny rail.

Contemporary tactical firearms make widespread use of the Picatinny rail as a means to attach accessories to the firearm platform being enhanced. Indeed, one or more Picatinny rails can be hard mounted, either by forging, screwing or adhering on a weapons platform in desired locations useful for mounting accessories. Due to the increased use of tactical accessories, some weapons platforms include one or more Picatinny rails. In light of certain configuration limitations (e.g., a manufacturer's rail placement, mechanical, and optical sights), however, users cannot always directly mount accessories in desired locations. Typically, this is because additional accessories can interfere with optical sight paths, disturb firearm-operating mechanisms, and/or be inappropriately positioned resulting in improper firearm usage.

In light of the above discussed and other existing drawbacks, there exists a need for improved mounting brackets associated with firearms used to carry or mount various devices, such as electro-optic devices. It is to such mounting brackets and mounting bracket construction methods that the various embodiments of the present invention are directed.

SUMMARY OF EXEMPLARY EMBODIMENTS

Various embodiments of the present invention provides rifle pistol, and/or crew served weapons users with a robust and secure means to attach a variety of accessories to Picatinny Rails on firearms, weapons or any other devices equipped with a Picatinny Rail. Described and illustrated herein are various mounting bracket embodiments used for mounting firearm accessories to firearms. Such accessories can include various electro-optic devices used to assist shooters in acquiring, illuminating, locating, and engaging targets. According to some embodiments, a mounting bracket can be attached to a Picatinny rail disposed on a firearm and the mounting bracket can also comprise a Picatinny rail. In some embodiments, a mounting bracket can be configured or shaped to mimic the exterior of a firearm. Such an advantageous feature enables mounting brackets to be attached to a firearm yet provide a low drag profile.

As discussed below, various embodiments of the present invention include methods to fabricate and manufacture mounting brackets. In some such embodiments, the below discussion may discuss bracket embodiments being attached to weapons platforms. In other fabrication embodiments, brackets may be manufactured as integral components of weapons platforms. In addition, in some embodiments, the brackets discussed herein can be made as an integral manufactured item, and in others, the brackets discussed herein can be fabricated from one or more components. The appended claims are intended to cover all fabrication variations.

Broadly described, embodiments of the present invention can be provided as a mounting bracket to provide additional mounting surface to carry a firearm accessory. Generally, a mounting bracket can comprise a plurality of mounting arms and a plurality of securing mechanisms. The plurality of mounting arms can be configured to each engage a distinct portion of an exterior mounting surface located on a firearm. The plurality of mounting arms can also respectively comprise opposing first ends and second ends. The plurality of securing mechanisms can be disposed proximate the first ends of the plurality of mounting arms. The securing mechanisms can be configured to detachably affix the plurality of mounting arms to the exterior mounting surface. This configuration can enable the second ends of the plurality of mounting arms to carry one or more accessory devices at one or more locations away from the exterior mounting surface.

Mounting brackets of the present invention can also comprise additional characteristics. For example, mounting brackets can comprise a mounting surface. The mounting surface can be disposed proximate the plurality of mounting arms. The mounting surface can be held at distinct portions along its length by the mounting arms. In some embodiments, the mounting arms can comprise first, second, and third mounting arms. The first and second arms can be coupled to opposing ends of the first mounting surface and extend diagonally divergent from each other. The third mounting arm can be disposed intermediate the first and second arms. Some embodiments can also comprise a mounting surface coupled to the plurality of mounting arms. The mounting surface can comprising a rail attachment surface that extends at least a portion along the length of the mounting surface.

Mounting brackets of the present invention can also comprise additional features. For example, mounting brackets can comprise a mounting surface that comprises at least one attachment area configured to carry at least one accessory device on the mounting surface. In addition, mounting brackets can comprise mounting arms being shaped at least along a portion of their lengths to generally correspond to an exterior shape of a firearm body. In addition, mounting arms can comprise first, second, and third mounting bracket arms. The first and second mounting bracket arms can extend from opposing end portions of a mounting surface. The third mounting bracket arm can extend from the mounting surface and be disposed intermediate the first and second mounting bracket arms. The third mounting bracket arm can be offset from the first and second mounting brackets to define spaces between the first and second mounting bracket arms and the third mounting bracket arm. At least one of the plurality of mounting arms can extends in an anhedral direction away from the exterior mounting surface in some embodiments of the present invention. Such a configuration enables that one or more accessory devices are disposed at an anhedral location offset from the exterior mounting surface. In addition, mounting surfaces disposed on mounting brackets can be arranged at an angle ranging between approximately 0 and approximately 90 degrees from the exterior mounting surface, according to some embodiments.

Embodiments of the present invention can also include methods to manufacture detachable mounting brackets for carrying one or more firearm accessory devices. A fabrication method can generally comprise providing one or more mounting arms configured to lockably engage one or more distinct portions of a firearm exterior surface and providing one or more mounting surfaces proximate distal ends of at least one of the mounting arms. The mounting surfaces configured to carry one or more accessory devices. A method can also include configuring at least one or more mounting arms in a sloping arrangement. In such a configuration, distal ends of the mounting arms can have an anhedral location offset from the firearm exterior surface.

Method embodiments of the present invention can also include additional features. For example, a method can include providing or configuring mounting arms as tapered, cantilever truss members. In addition, a method can include coating at least mounting arms and mounting surfaces with a protective coating. Methods can also include providing a detachably affixable securing mechanism for securing mounting arms to a firearm exterior surface. This enables mounting arms to be detachably affixed to a firearm exterior surface. Methods may also include providing mounting surfaces as a single continuous attachment rail. Mounting surfaces can be positioned at an anhedral location offset from the exterior mounting surface according to some methods. Method embodiments can still yet include providing three mounting arms and configuring the three mounting arms to distribute loads and vibrations over at least a portion of an exterior firearm body surface. Some method embodiments can also include providing one or more recesses or gaps on an exterior surface of at least one of the mounting arms or the mounting surfaces. Such recesses or gaps can provide structural strength to mounting bracket embodiments. Method embodiments can include manufacturing all or some parts of a mounting bracket with aluminum, aluminum alloy, or similar lightweight durable, rigid materials.

According to still yet other embodiments, mounting brackets can provide a mounting surface to carry a firearm accessory device. A mounting bracket can generally comprise an elongated attachment member, one or more securing mechanisms, and one or more transverse members. The elongated attachment member can comprise at least a portion along its length a rail attachment surface configured to carry to carry one or more accessory devices. The one or more securing mechanisms can be set off from the elongated attachment member. The one or more securing mechanisms can be configured to be securedly attachable to an exterior firearm surface. The one or more transverse members can extend away from the elongated integral attachment member toward the one or more securing mechanisms. The one or more transverse members can each comprise opposing first and second ends. The first ends can be disposed proximate the one or more securing mechanisms and the second ends can be disposed proximate the elongated attachment member.

Mounting bracket embodiments can also include additional other features. Indeed, a mounting bracket can include one or more securing mechanisms that comprise a clamp member and a securedly detachable tension member disposed therethough and proximate the first ends. The clamp member and the securedly detachable tension member can be configured to be securedly attachable to a rail attachment surface and disposed on an exterior firearm surface. In addition, a mounting bracket can include ends of the transverse members being spaced apart from each other. A spaced apart configuration enables the one or more transverse members to be attached to different positions of an exterior firearm surface. The one or more transverse members can be shaped in a generally anhedral configuration. Such a configuration positions an axis of the elongated attachment member in a diagonally offset from an axis formed between the one or more securing mechanisms.

Mounting bracket embodiments can still yet include additional other features. Transverse members can comprise first, second, and third transverse members that spaced apart from each other. The first transverse member can extend diagonally from one end of the elongated attachment member. The second member can extend diagonally from another end of the elongated attachment member. In addition, the third member can be disposed between the first and second transverse members and extend generally perpendicular from a central portion of the elongated attachment member. The elongated attachment member, the one or more securing mechanisms, and the one or more transverse members can be fabricated to form an integral bracket component. In addition, in some embodiments, the elongated attachment member can be generally positioned parallel to a bore axis of a firearm. Mounting brackets in some embodiments can also include an elongated attachment member that has a length less than a length formed between two opposing-end securing mechanisms.

Other aspects, features, and embodiments of the present invention will become apparent to those of ordinary skill in the art, upon reviewing the following description of specific, exemplary embodiments of the present invention in conjunction with the accompanying figures. In addition, while features of the present invention may be discussed relative to certain embodiments and figures, all embodiments of the present invention can include one or more of the advantageous features discussed herein. In other words while one or more embodiments may be discussed as having certain advantageous features, one or more of such features may also be used in accordance with the various embodiments of the invention discussed herein.

DETAILED DESCRIPTION OF PREFERRED & ALTERNATIVE EMBODIMENTS

Figure 1:
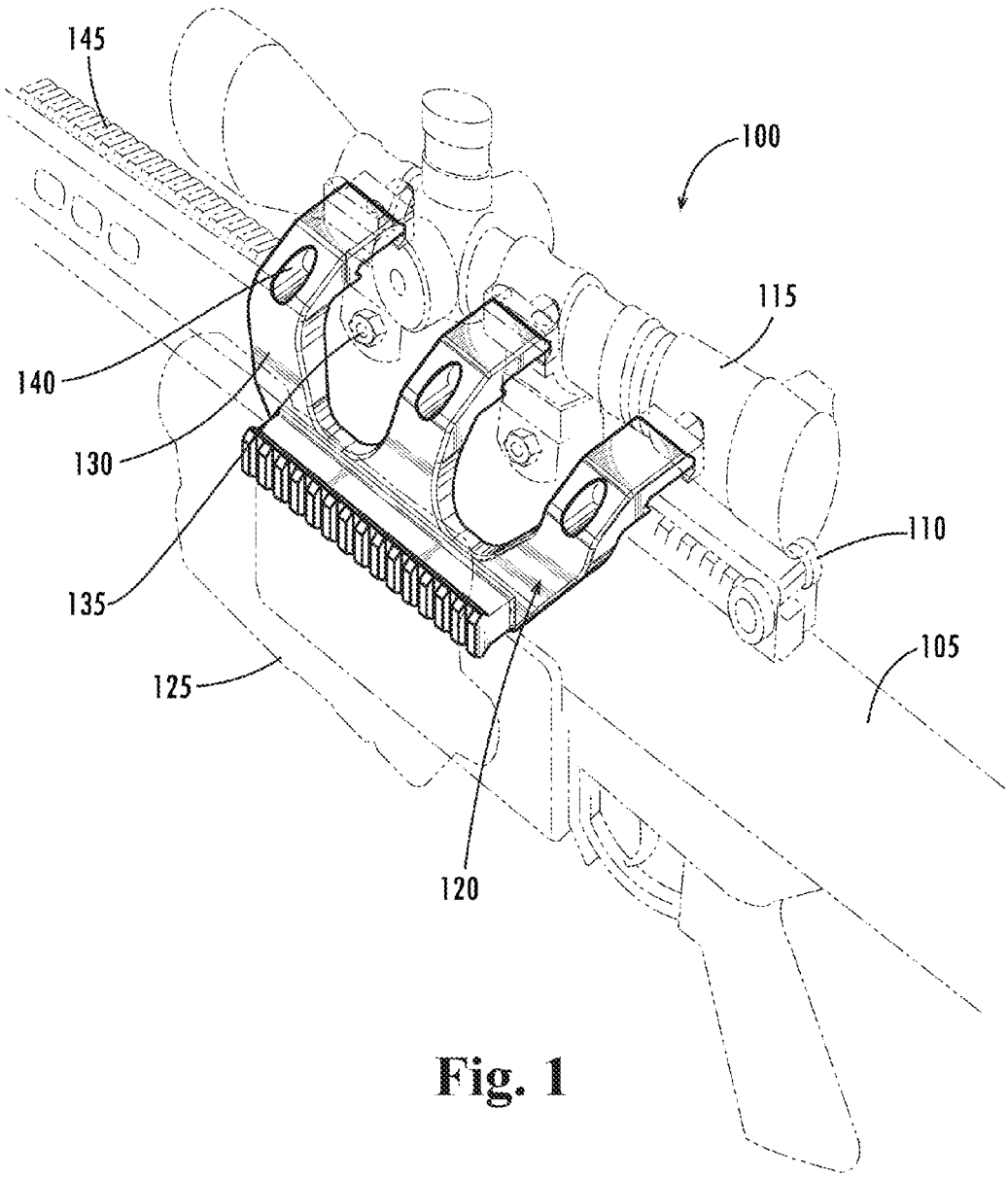
FIG. 1 illustrates a perspective view of an accessory mounted to a firearm using a mounting bracket in accordance with some embodiments of the present invention.

Referring now to the figures, wherein like reference numerals represent like parts throughout the several views, exemplary embodiments of the present invention will be described in detail. Throughout this description, various components may be identified as having specific values or parameters, however, these items are provided as exemplary embodiments. Indeed, the exemplary embodiments do not limit the various aspects and concepts of the present invention as many comparable parameters, sizes, ranges, and/or values may be implemented.

Some embodiments of present invention provide a mounting system adapted to provide a supplemental secure, and precisely positioned 1913 spec Picatinny rail on a M107 Barrett 0.50BMG sniper rifle for the mounting of a STORM multi-function laser ("STORM"). Embodiments of the invention are not, however, limited to a mounting system for the support of a STORM on a Barrett. Embodiments of the present invention can be used to provide supplemental mounts for many accessories on a variety of equipment and are not limited to providing additional Picatinny rails.

Embodiments of the present invention can be manufactured to have various characteristics. For example, some embodiments can be constructed as a high strength lightweight mount that will accommodate various accessories in parallel alignment with a rifle bore, and line of sight with a significantly reduced visual profile. Mounting bracket embodiments can also be optimized by design by being a ruggedized structural member capable of withstanding repeated, random multi-axis shocks and vibrations being transferred from a rifle during field use. Such an advantageous engineering design attributes optimize its strength to weight ratio, periodic load sustainability, forced vibration dampening and absorption of torsion flex energy were incorporated into its design.

Embodiments of the present invention can also comprise a heavy-duty anhedral tri-bifurcate (forked) architecture. Such architecture can provide minimal lateral and longitudinal flex by distributing loads and vibrations over a greater surface area. In some embodiments, a high strength basic arm/beam shape of the bracket is generally comprised of angled extensions for support at the attachment points on the rifle, and three tapered cantilever truss-like sections (tri-bifurcate/fork) with downward sloping angles. According to some embodiments, a mounting bracket may culminate in an integrated 1913 spec Picatinny Rail or other mount as desired.

Other embodiments can incorporate dihedral and polyhedral mount orientations with bi- and tri-bifurcated (forked) architecture. A tapered, anhedral, tri-bifurcate (forked) base structure can position one or more accessories close to the main body of the firearm reducing inadvertent impact and snag hazards encountered by the user. Providing an advantageous architectural design of mounting bracket embodiments discussed herein enables superior stiffness and dynamic flex reduction when under recoil forces from the rifle firing. Using various high-strength lightweight provides high strength to weight ratios. For example, 7000 series Aluminum alloy can provide strength to weight ratio approximately double that of conventional steels and high levels of corrosion resistance.

Embodiments of the present invention can also comprise utilizing protective coatings. For example, some embodiments may include coatings adapted to provide protection from adverse environmental conditions by applying various industrial coatings such as, but not limited to, paint, powder coating, PVD, or anodizing. For example, Class III Type 2 hard anodizing further hardens the brackets substrate surface, prevents corrosion, and can be provided in a range of colors. An additional benefit of using the 7000 series Aluminum alloy is that the mount is approximately 35% lighter than steel by volume. Some embodiments can be manufactured using CNC machining, precision extrusions, forgings, and castings.

FIG. 1 illustrates a perspective left side view of a rifle 105 carrying a mounting bracket 120 in accordance with some embodiments of the present invention. Attached to the mounting bracket 120 is a multi-function laser 125. In this illustration, the rifle 105 is a 0.50 caliber semi-automatic rifle. It should be understood that embodiments of the present invention can be used with various other firearm types.

As is shown, the rifle 105*s* includes various mounting surfaces. One surface is a Picatinny rail 110 disposed on a top side of the rifle 105. The Picatinny rail 110 can be either located by a manufacturer or as an after market component. Attached to the Picatinny rail 110 is an optical scope 115. As seen in this illustration, the scope 115 uses a large amount of space (lengthwise) on the Picatinny rail 110 due to its elongated configuration. As a result, the Picatinny rail 110 has limited availability to hold other devices in such a manner so as not to disturb functional operation of the optical scope 115. Users can employ other devices for use with the optical scope 115, but this usually requires that any additional accessories be mounted in the remaining space available, in-line, and either in front or behind the scope 115. Such a configuration typically renders one or both pieces of equipment either significantly less effective and/or sometimes altogether useless.

Embodiments of the present invention generally comprise mounting bracket systems that provide an additional mounting surface. For example, as shown in FIG. 1, the mounting bracket 120 provides an additional mounting surface 122. The mounting surface 122 is not fully shown in the drawing due to it carrying the laser 125. The mounting surface 122 can comprise a rail attachment surface (e.g., a Picatinny rail or other type rails). In other embodiments, the additional mounting surface 122 can be configured for use with and to carry many other accessory devices. Indeed, the mounting surface 122 need not be an attachment rail surface. In some embodiments, the mounting surface 122 may comprise one or more rail attachment surfaces at least along a portion of the length of the mounting surface 122.

As shown in FIG. 1, the mounting surface 122 enables a user to use an additional electro-optics device, the laser 125, in concert with another device located on the Picatinny rail 110. For example, when it is desirable to mount additional accessories to the rifle 105, or indeed to any equipment with limited Picatinny rails, the mounting system 120 can be installed quickly and easily. Quick and easy installation advantageously enables one or more accessories to be used with weapons platforms lacking available attachment surfaces for holding multiple tactical optics and sighting devices.

Again, as shown, in FIG. 1 the rifle 105 is equipped with an optical scope 115. The optical scope 115 is mounted to a Picatinny rail 110 located on a top surface of the rifle 105. In this figure, the mounting system 120 can be used to mount an accessory device, such as the laser 125, to an exterior side of the rifle 105. In some embodiments, accessory devices can be mounted perpendicular to a plane formed by the top surface 145 of the Picatinny rail on the rifle 105. In addition, in some embodiments, accessory devices can be mounted in parallel with a bore axis of a firearm. Other mounting angles are also achievable in other embodiments of the present invention.

Embodiments of the present invention can be implemented for use in various manners. For example, and as shown in FIG. 1, the mounting bracket 120 can be mounted directly to a Picatinny rail. The illustrated mounting implementation can be carried out with the use of one or more mounting bracket arms (sometimes referred to as mounting forks or forks). For example, and as illustrated, the mounting bracket 120 comprises three mounting bracket arms 130A, 130B, 130C (collectively referred to as bracket arms 130). The bracket arms 130 can have opposing ends (as partially shown in FIG. 1). One end can be configured for attachment to the rifle's 105 Picatinny rail, and another end can be disposed toward a mounting surface enabling the bracket to securely hold an accessory device.

The bracket arms 130 of the mounting bracket 120 can be sized, shaped, and configured in various manners. As discussed in more detail below, the bracket arms 130 can be configured as tapered beams. Indeed, the bracket arms 130 can be configured as cantilever trusses enabling the mounting bracket 120 to securely hold an accessory device and withstand rigorous vibration and heavy loads. In addition, and as shown, the bracket arms 130 can be spaced apart from each other. Spacing the bracket arms 130 from each other in a forked fashion defines spaces between the bracket arms 130. The spacing of the bracket arms 130 enables the mounting bracket 120 to distribute vibrations and loads over a surface area to ensure that the mounting bracket 120 is capable of withstanding large applied forces. In addition, provision of one or more mounting bracket arms intermediate opposing end bracket arms enables such an intermediate bracket arm to control and dissipate vibrations.

The bracket arms 130 can be configured for attachment to a firearm to provide a mounting surface in various manners. As shown in FIG. 1, the bracket arms 130 are attached directly to the rifle's 105 existing Picatinny rail. In other embodiments, the bracket arms 130 may be configured for attachment to other rail attachment surfaces as well as an exterior firearm surface. Attaching the mounting bracket to a rail attachment surface (e.g., a Picatinny rail) may be desired in some applications, such as those where large caliber weapons are being used and when a weapon has a rail attachment surface (e.g., a Picatinny rail) located on its exterior surface. In addition, the bracket arms 130 can be attached to distinct portions of a firearm exterior surface. Such a multi-attachment configuration provides a secure bond to a firearm exterior surface at multiple locations and assists in enabling rapid attachment to a firearm.

Figure 2:
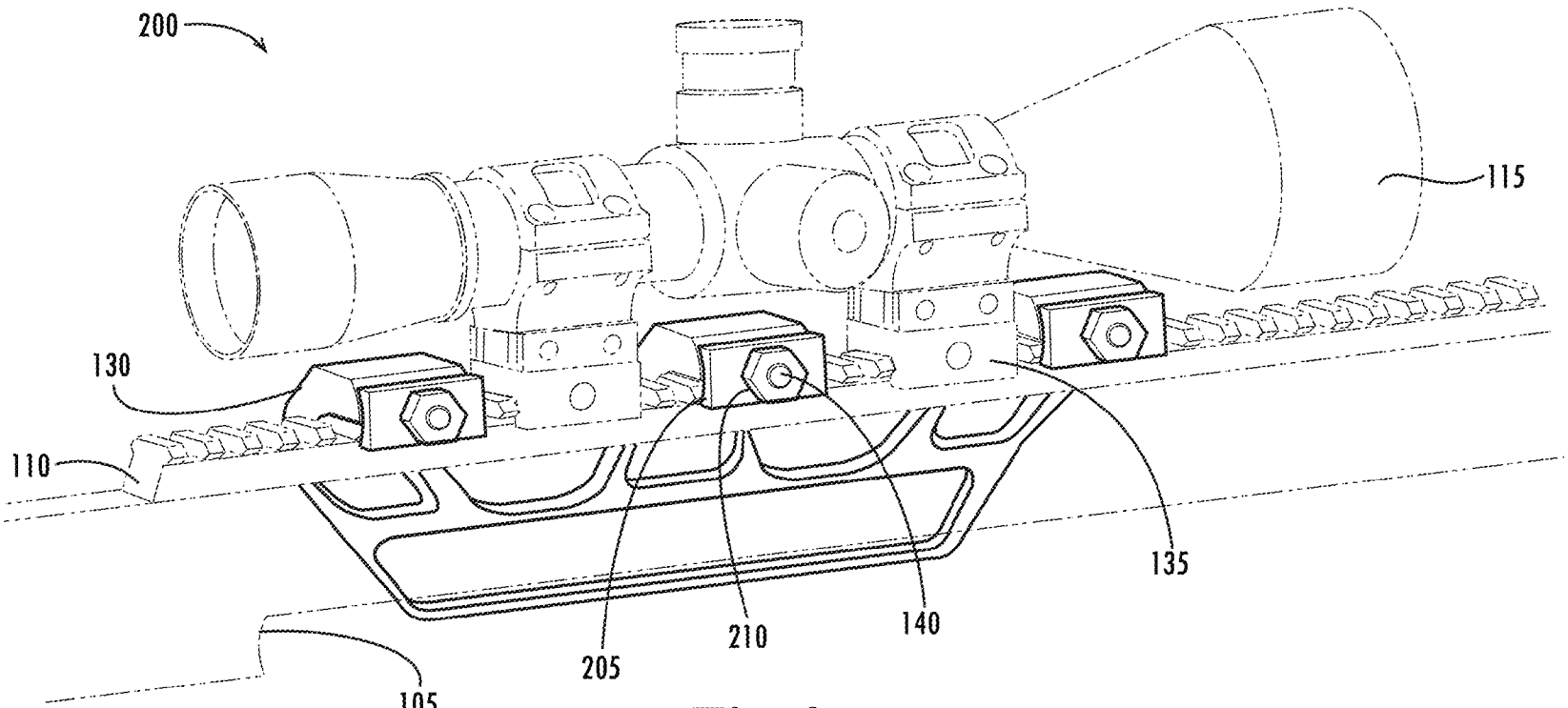
FIG. 2 illustrates a perspective view of a mounting bracket in accordance with some embodiments of the present invention and a scope mounted to a rail attachment surface.

The bracket arms 130 are preferably configured to be easily attached and detached from a firearm with ease. As best shown in FIGS. 1-2, the bracket arms 130 each comprise a clamping portion and a tension member. The clamping portion can be used to clamp a firearm exterior surface (e.g., a Picatinny rail) and the tension member can be configured to provide tension to lock the clamping portion to a firearm exterior surface (e.g., a Picatinny rail). In some embodiments, and as currently preferred, the tension member can be provided as threaded bolt to be used in concert with a locking bolt. The threaded bolt can extend through the clamping portion and a Picatinny rail and be held securely in place by tightening of the locking bolt. Such a configuration enables application of a desired locking torque to ensure that the mounting bracket 120 is securedly attached to a firearm.

As can be appreciated, large caliber firearms, such as a 0.50 caliber, can deliver large amounts of force to devices attached to it. Thus, for design and safety issues, presently preferred embodiments enable users to tightly secure mounting brackets to firearms as desired (i.e., to desire torque settings). In some embodiments, it may be desirable to utilize other types of locking mechanisms, such as snapping pieces, hand tight-enable tension members, clasps, buckles, and the like. Still yet in some embodiments, tools may be provided for use with tension members so that users can quickly tighten and loosen tension members for quick installation and de-installation of the mounting bracket 120.

As mentioned above (and as shown in FIGS. 1-9), bracket arms in the various illustrated embodiments of the present invention can be configured in a spaced out arrangement. Indeed, as shown in the illustrated embodiments, the bracket arms 130 can be spaced apart from each other. As illustrated in FIG. 1, this configuration enables attachment of the mounting bracket 120 to the rifle 105 in a manner that avoids clamping scope rings 135 used to attach the optical scope 115 to the rifle 105. Spacing between the mounting bracket arms 130 can vary in accordance with embodiments of the present invention. In currently preferred embodiments, spacing between outer bracket arms 130A, 130C, preferably increases in a divergent manner toward attachment points use for attaching the mounting bracket 120 to the rifle 105. The divergent manner can be configured such that bracket arms 130 extend away from the mounting surface 122 in a diagonal manner. As shown, a center bracket arm 130B can be generally disposed parallel to the mounting surface 122. Thus, opposing end bracket arms 130A and 130C can also diverge away from a center bracket arm 130B as shown.

FIG. 1 also shows mounting bracket 120 being disposed on one side of the rifle 105. This design is due to the location of the rifle 105's action ejection port located on the other exterior side of the rifle. In alternative embodiments, the mounting bracket 120 can be configured for attachment to be on an opposing exterior side of a rifle in the case a left-positioned bolt or ejection port. Thus, embodiments of the present invention may be positioned on either side of a firearm as desired to avoid a firearm's action and ejection port.

FIG. 2 illustrates a perspective side view of a mounting bracket system 200 in accordance with some embodiments of the present invention. In this illustration, a mounting bracket 120 is mounted to a rail attachment surface 110 located on an exterior surface of a rifle body. In particular, the rail attachment surface 110 is located along a portion of a rifle barrel. Also mounted to the rail attachment surface 110 is an optical scope 115.

The mounting bracket system 200 shown in FIG. 2 provides a perspective view of an underside exterior 123 of the mounting bracket 120. As shown, through this view (in which the rifle barrel has been illustrated with shading lines), it is possible to see how the mounting bracket fits along the side of a rifle body 105. Indeed, as shown in this view, the underside exterior 123 of the mounting bracket 120 is shaped to correspond to the exterior shape of the rifle body 105. In this way, and in accordance with currently preferred embodiments, the mounting bracket 120 is configured to fit snugly against and/or hug close to the exterior of the rifle body. This arrangement enables the mounting bracket 120 to have a low drag profile and not append too far away from the exterior surface of the rifle body.

FIG. 2 also illustrates in detail certain features of the above described clamping portion and tension member. The clamping portions can have two ends, each configured to clamp against a mounting surface provided, located, and/or disposed on an exterior surface of a rifle body. One end of the clamping portion can be machined directly into the mounting are brackets 130, and another end can be clamped using a bolt 140 and a nut 210. In other alternative embodiments, and as mentioned above, for ease of operation, the nut 210 may be a wing nut or a lever, which can enable tool-less removal of the mounting bracket 120.

Figure 3:
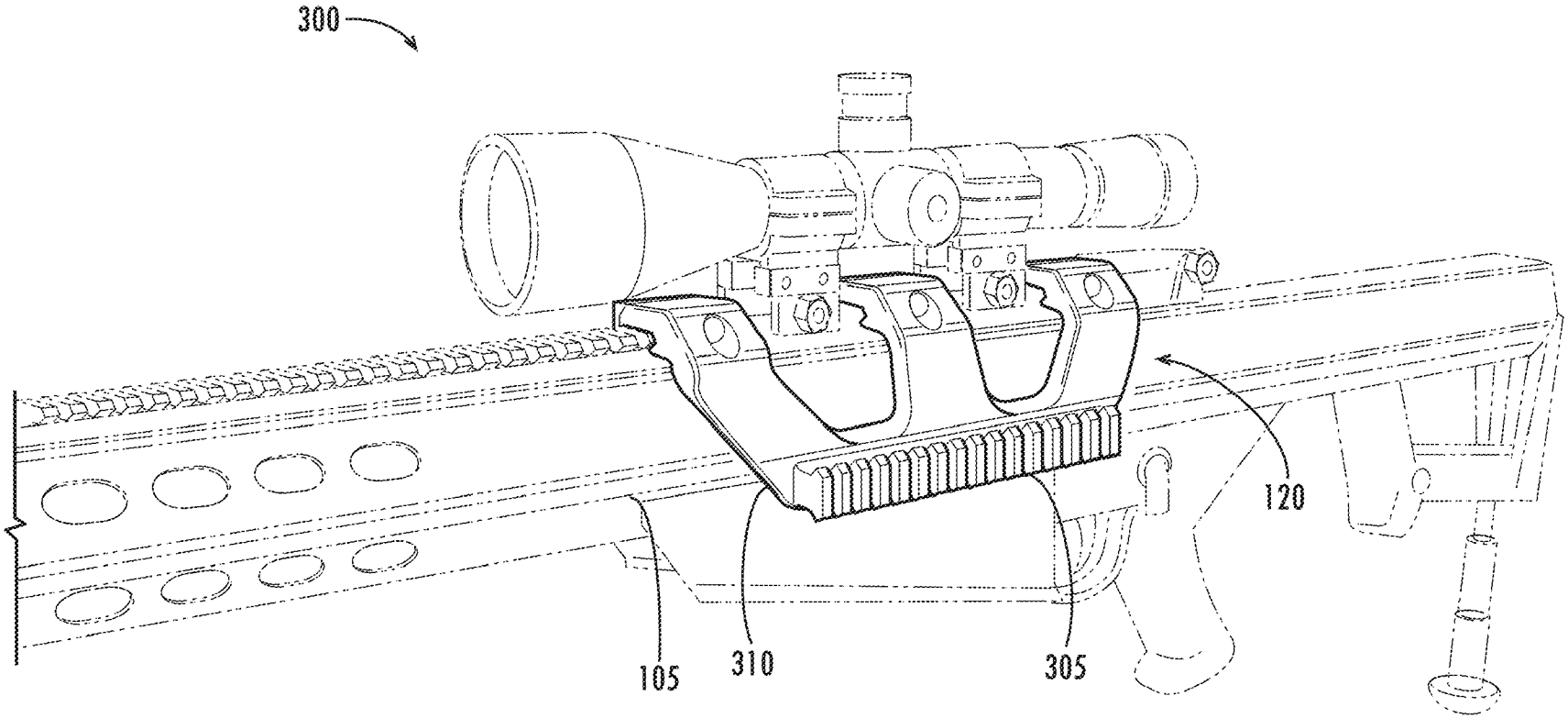
FIG. 3 illustrates a perspective view of a mounting bracket in accordance with some embodiments of the present invention and a scope mounted to a firearm.

FIG. 3 illustrates a perspective side view of a mounting bracket system 300 in accordance with some embodiments of the present invention. The system 300 depicts a left hand side of a rifle 105 with a mounting bracket 120. In this view, no accessory device has been mounted to the mounting bracket 120. As shown in this view, the mounting bracket can comprise an outer surface that includes a rail attachment surface (e.g., a Picatinny rail) at least along a portion of its length. In currently preferred embodiments, this rail attachment surface can be machined or cast directly into the mounting bracket 120 to form an integral bracket component. In alternative embodiments, the mounting bracket 120 may have a separate mounting plate 310 to which a rail attachment surface (e.g., a Picatinny rail) may be attached using bolts, screws, adhesives, weld, glues, or other such fastening features. In yet other alternative embodiments, the mounting bracket 120 can comprise other non-rail type attachment surfaces. Such various attachment features enable the mounting brackets 120 to be used with many firearm platforms and accessories. Indeed, these include accessories that do not use a rail attachment system. In some embodiments, the mounting bracket 120 can be custom manufactured to accept many different types of mounts and/or allow accessories to be directly attached to the mounting plate 310.

Figure 4:
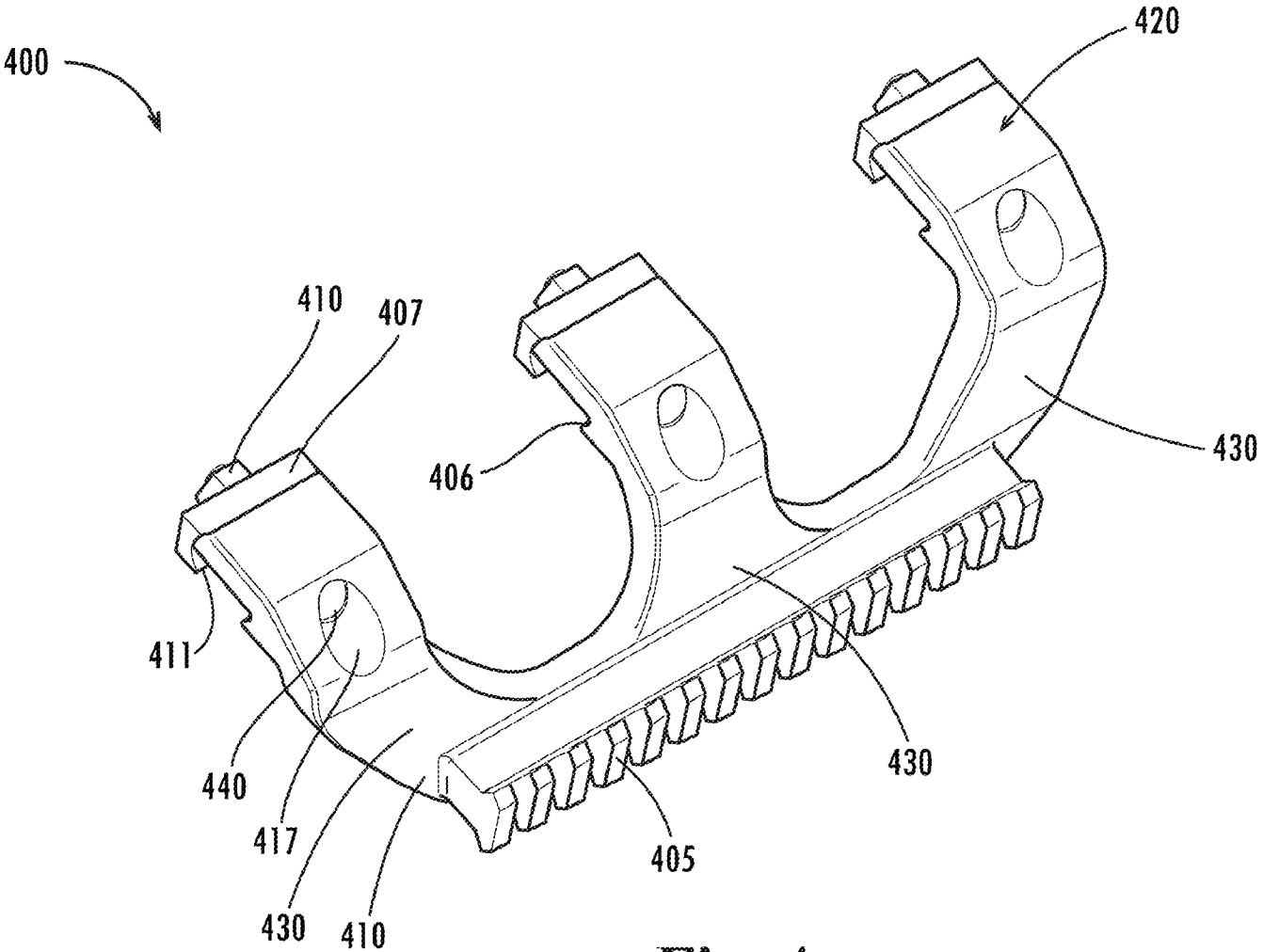
FIG. 4 illustrates a perspective view of a mounting bracket provided in accordance with some embodiments of the present invention.

FIG. 4 illustrates a perspective view of a mounting bracket 400 embodiment provided in accordance with some embodiments of the present invention. The mounting bracket 400 is shown in a stand-alone, un-mounted view. In some embodiments, a Picatinny rail 405 may be mounted to a mounting plate 410 and the various components of the mounting bracket can be joined together to form the mounting bracket 400. Indeed, in some embodiments, it may be desired to couple clamping portions 415, mounting forks 430, mounting plate 410, and a mounting surface 405 to form the mounting bracket 400. In other, and currently preferred embodiments, the mounting bracket 400 is machined as an integral component. An integral component can provide a mounting bracket 400 with desired structural integrity. In yet other alternative embodiments one or more of the mounting bracket components 400 can be an integral component and any other mounting components can be joined or coupled to the integral component to yield the mounting bracket 400.

The mounting bracket 400 can be mounted to a weapons platform using three mounting forks 430A, 430B, 430C (collectively 430). One end of the forks 430 can comprise mounting surfaces 406, 411 allowing attachment to an attachment surface located on an exterior surface of a weapons platform. While currently preferred embodiments utilize three forks 430, more or less forks can be used in accordance with other embodiments of the present invention. A three forked embodiment of the present invention can be used to withstand the repeated, random shock, and vibrations that can be encountered as the result of being mounted to a firearm. The various forks 430 can be attached to a rail attachment surface of a weapons platform with a tension mechanism that can comprise a threaded bolt and nut (see FIGS. 6-7).

Using a tension mechanism, the mounting bracket 400 can be secured to an exterior surface of a firearm. For example, the mounting bracket 400 can include three bolts 440 used to adhere the mounting bracket 400 to a Picatinny rail located on a weapons platform. One side of a mounting surface can comprise three mounting plates 407 and three nuts 410. In some embodiments, the nuts 410 may be wing nuts, clips, levers, and other fastener types. The nuts 410 can be configured to enable the mounting bracket 400 to be removed without tools or heaving gloves. The mounting surface 411 of the mounting plate 411 is spaced apart (in opposing fashion) to the mounting surface 406. When the three nuts 410, or other fasteners, are tightened, the mounting system can be securely attached to a weapon's platform exterior mounting surface, such as a Picatinny rail.

In some embodiments, the mounting bolts 440 may simply be inserted through apertures 417 in the mounting bracket 400 to allow for replacement if necessary. The apertures 417 enable ends of the mounting bolts to be hidden within a cavity so that the bolt ends are protected and do not extend exterior to the mounting bracket 400. In alternative embodiments, the bolts 440 may be press-fit into apertures 417 machined in the mounting bracket 400 to prevent loss in operation, yet allow for replacement if necessary. In other embodiments, the bolts 420 may be cast directly into the mounting system (i.e., in the form of studs) to simplify manufacture, reduce manufacturing costs, and/or prevent loss.

Figure 5:
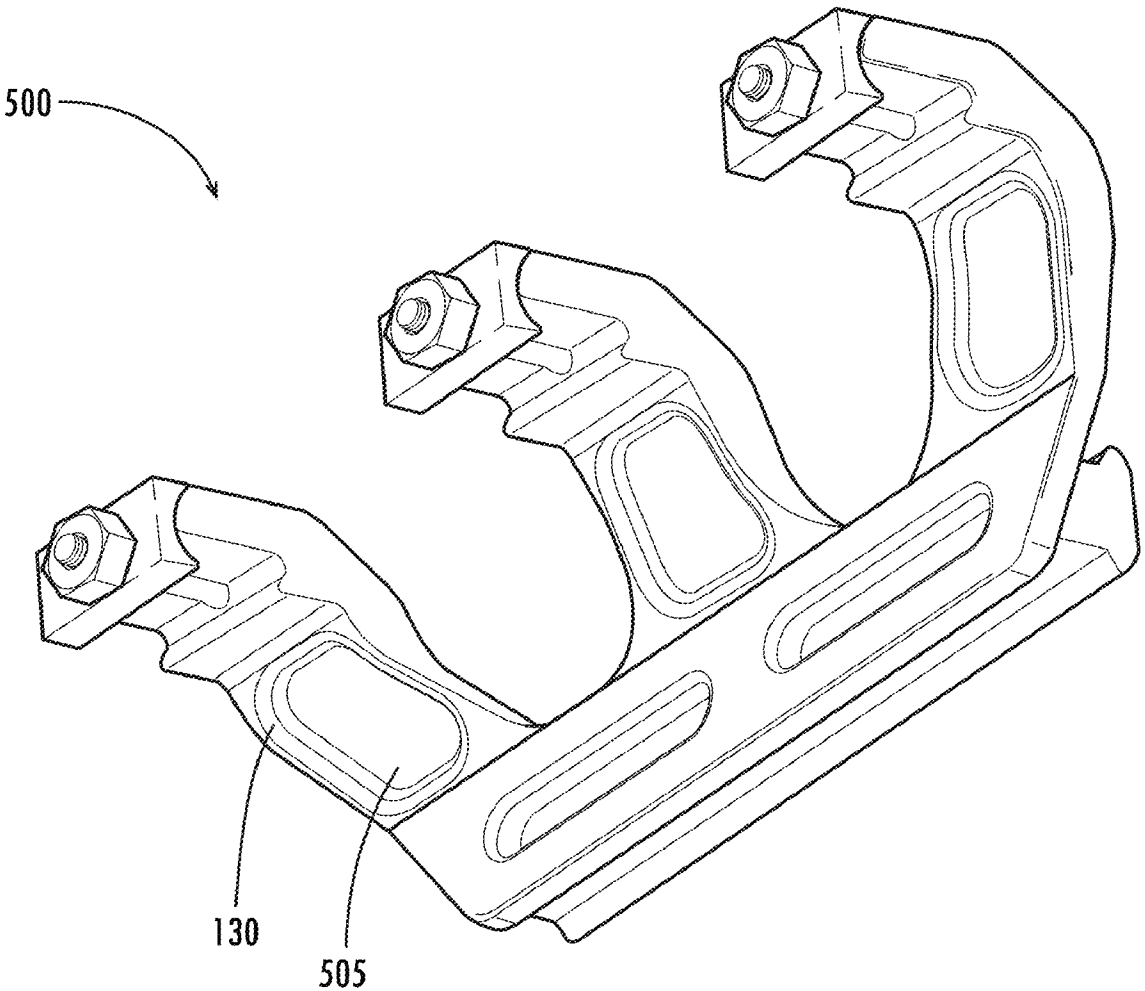
FIG. 5 is a perspective view of a mounting bracket provided in accordance with some embodiments of the present invention.
Figure 6:
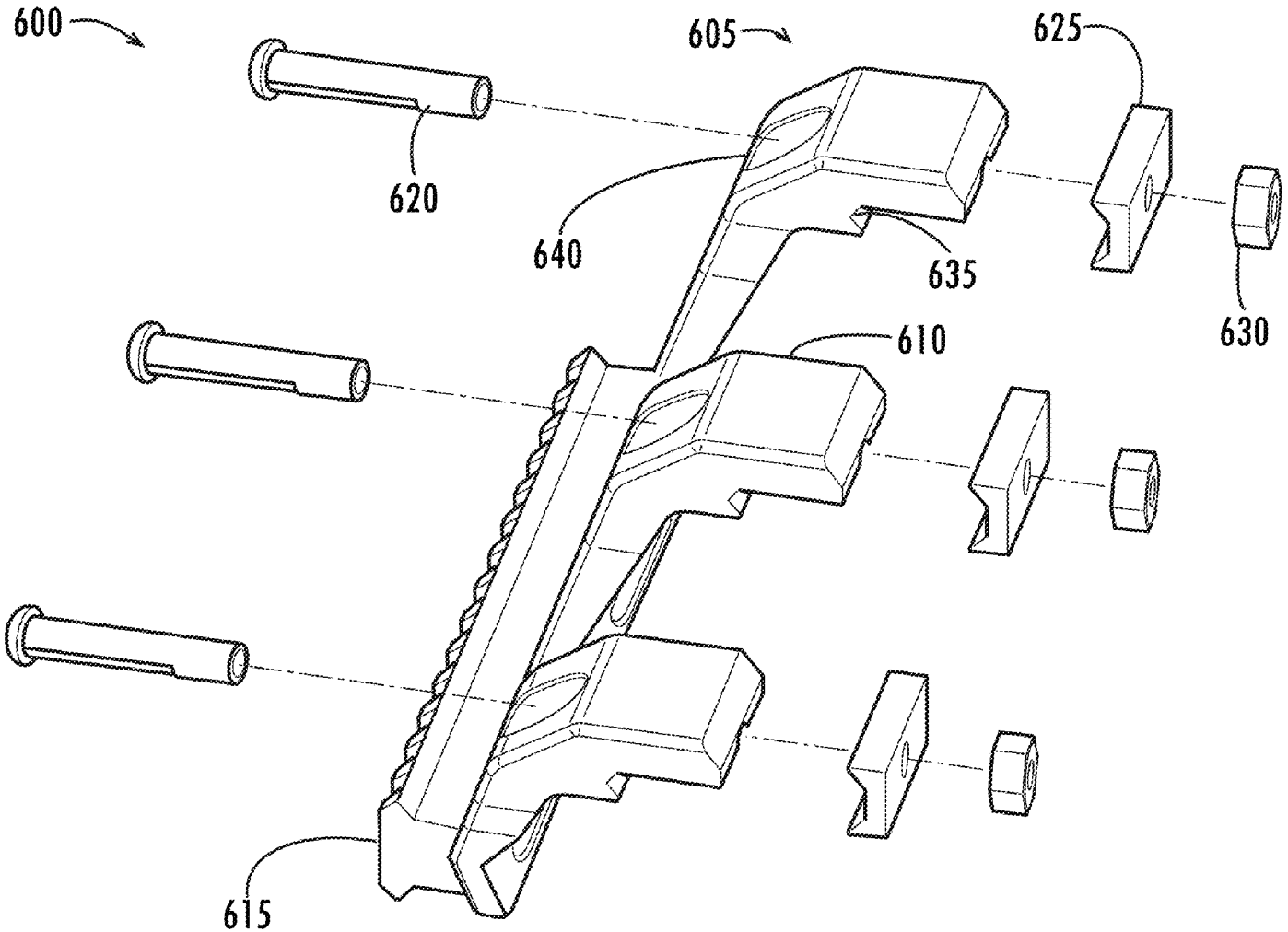
FIGS. 6-9 illustrate several exploded views of mounting bracket embodiments in accordance with some embodiments of the present invention.
Figure 7:
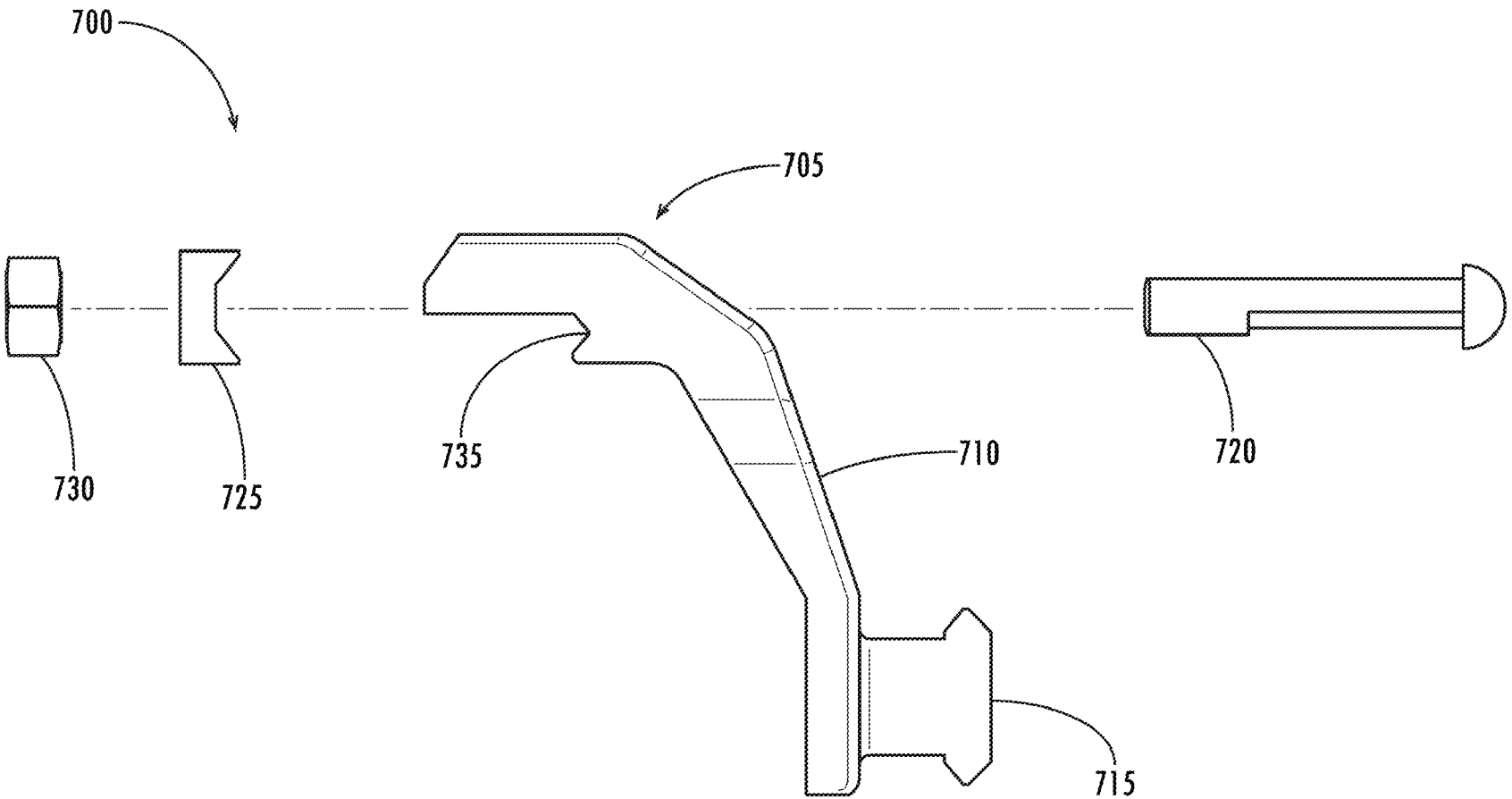
Figure 8:
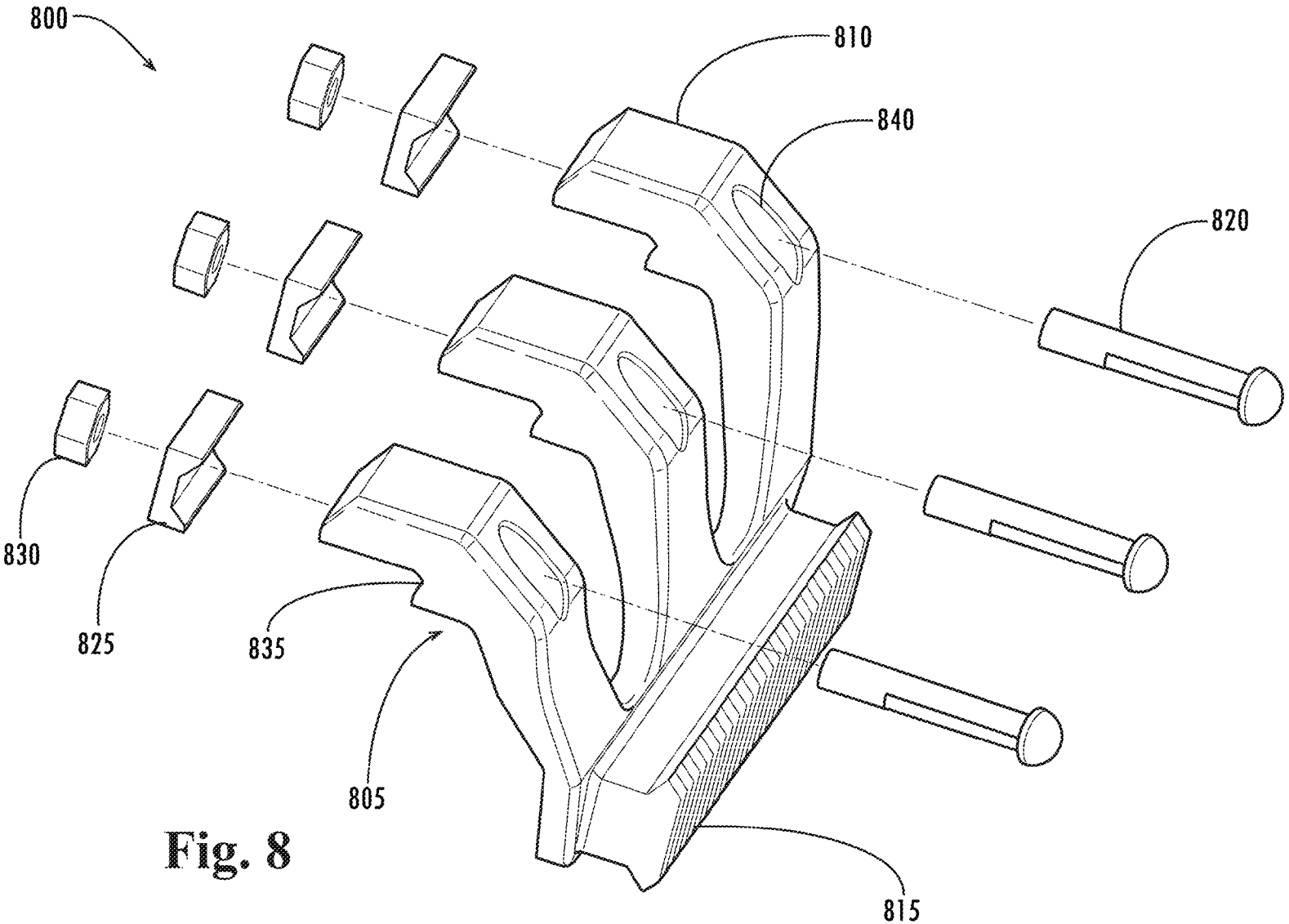
Figure 9:
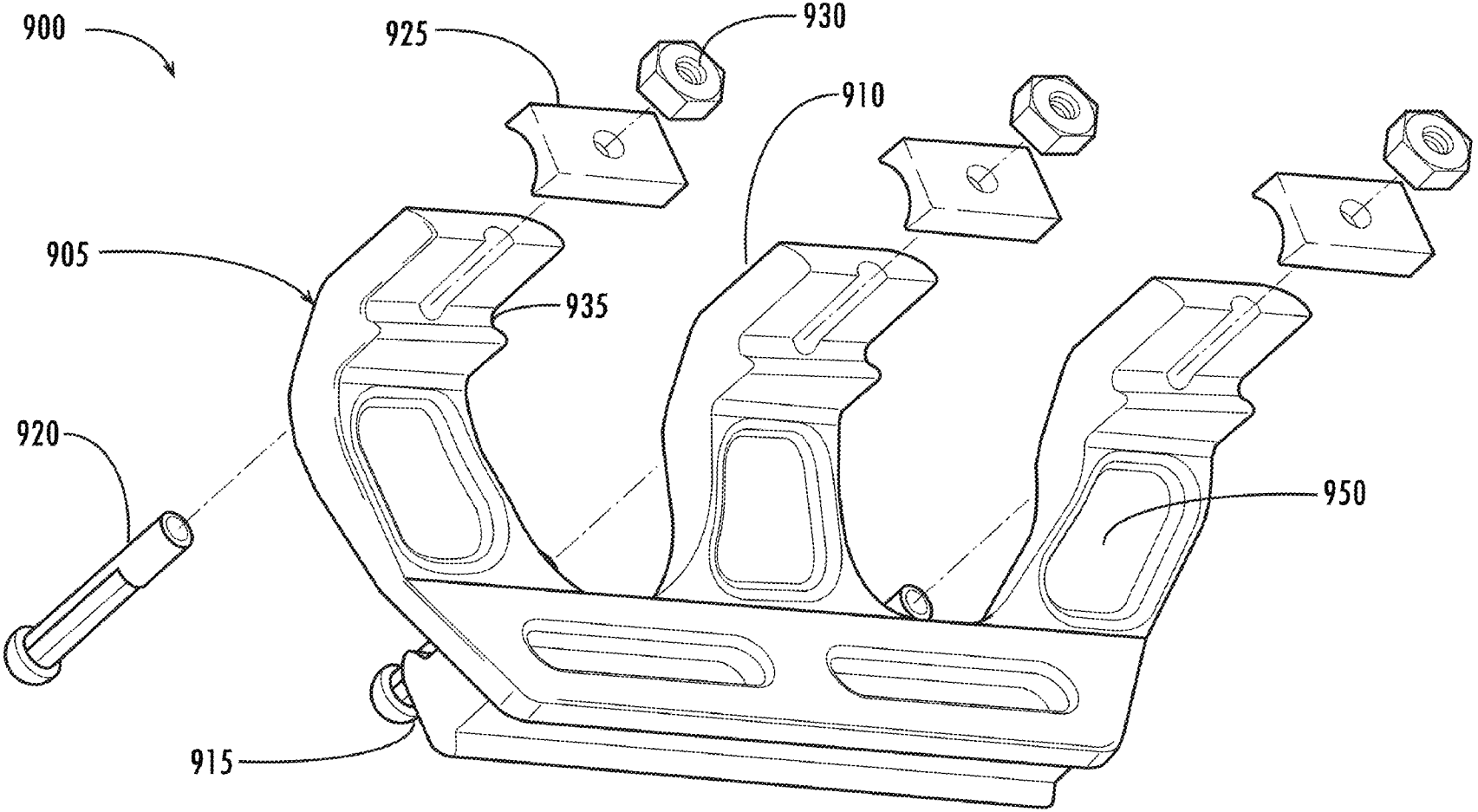

FIG. 5 is a perspective right three-quarter view of a mounting bracket 500 provided in accordance with some embodiments of the present invention. In some embodiments, such as the one shown in FIG. 5, the mounting bracket 500 may be approximately 8.3 inches long, 2.8 inches wide, 2.7 inches high, and weigh approximately 14 ounces. As shown, the mounting bracket 500 can comprise an arm/beam shape configured as three tapered and cantilevered truss-like sections 530 with angled extensions 505. The angled extensions can provide support for an attachment point when attaching the mounting bracket to a weapons platform. The tri-fork members 530 can provide a stable platform for carrying accessory devices. In addition, due to the accuracy of manufacture, the mounting bracket 500 can be easily and rapidly bore sighted to a weapon in the field (i.e., to align accessories with the bore of the weapon).

Another feature of some embodiments of the present invention can be seen in FIG. 5. As shown, the mounting bracket 500 can comprise one or more recesses (or gaps) formed in an underside (or rearside) exterior surface of the mounting bracket 500. For example, such recesses 505, 510, 515 can be located on the underside of each of the fork members 530. The recesses 505, 510, 515 can have a generally rectangular shape. In some embodiments the dimensions of the recesses 505, 510, 515 can be approximately 0.97 inches wide and 1.35 inches tall, and have a depression depth of 0.130 inches. In addition, a recess 520 can be formed behind an attachment surface. The recess 520 can be configured as an elongated recess or as multiple recess segments. The recess 520 can be dimensioned as 1.9 inches long by 0.32 inches wide, with a depression depth of 0.25 inches. Of course, other embodiments may have other dimensions. When shaping the recesses, the recesses should not be made too deep due to risk of breaking through the bracket wall, and likewise, the recesses should not be made too thin as this risks not removing desired weight. The recesses remove weight from the mounting bracket, and enhance the structural strength of the mounting bracket. As can be appreciated, the geometrical shape of the recesses provides increased strength when disposed into the mounting bracket yet also help in dissipating loads and vibrations over the mounting bracket 500 when attached to a weapons platform.

FIGS. 6-9 illustrate several exploded and cross-sectional views of mounting bracket embodiments 600, 700, 800, 900 in accordance with some embodiments of the present invention. These embodiments employ various of the features discussed above so for brevity, these embodiments are not discussed in detail. These embodiments also show various other features in accordance with the various embodiments of the present invention. For example, mounting bracket 600 shows that generally central axes passing through the attachment surface 605 and the connection mechanisms 610 are generally parallel. This parallel configuration enables a line of sight of an accessory device to be generally parallel to a bore axis of a firearm upon which the mounting bracket can mounted to for use. The mounting bracket 700 (shown in cross section) also illustrates the various geometric shapes of mounting arms in accordance with currently preferred embodiments. Specifically, mounting bracket 700 includes a tapered, cantilever bracket arm 705. Such a configuration provides a structurally sound mounting bracket. In similar fashion, the mounting bracket 800 an exploded view of the mounting bracket 800 and various coupling mechanisms used to attach the mounting bracket to a weapons platform. And finally, the mounting bracket 900 illustrates that recesses formed in an exterior underside surface of the mounting bracket can be formed as multiple co-located recesses, such as the two recesses 905, 910 formed rearwardly of a mounting surface.

Figure 10:
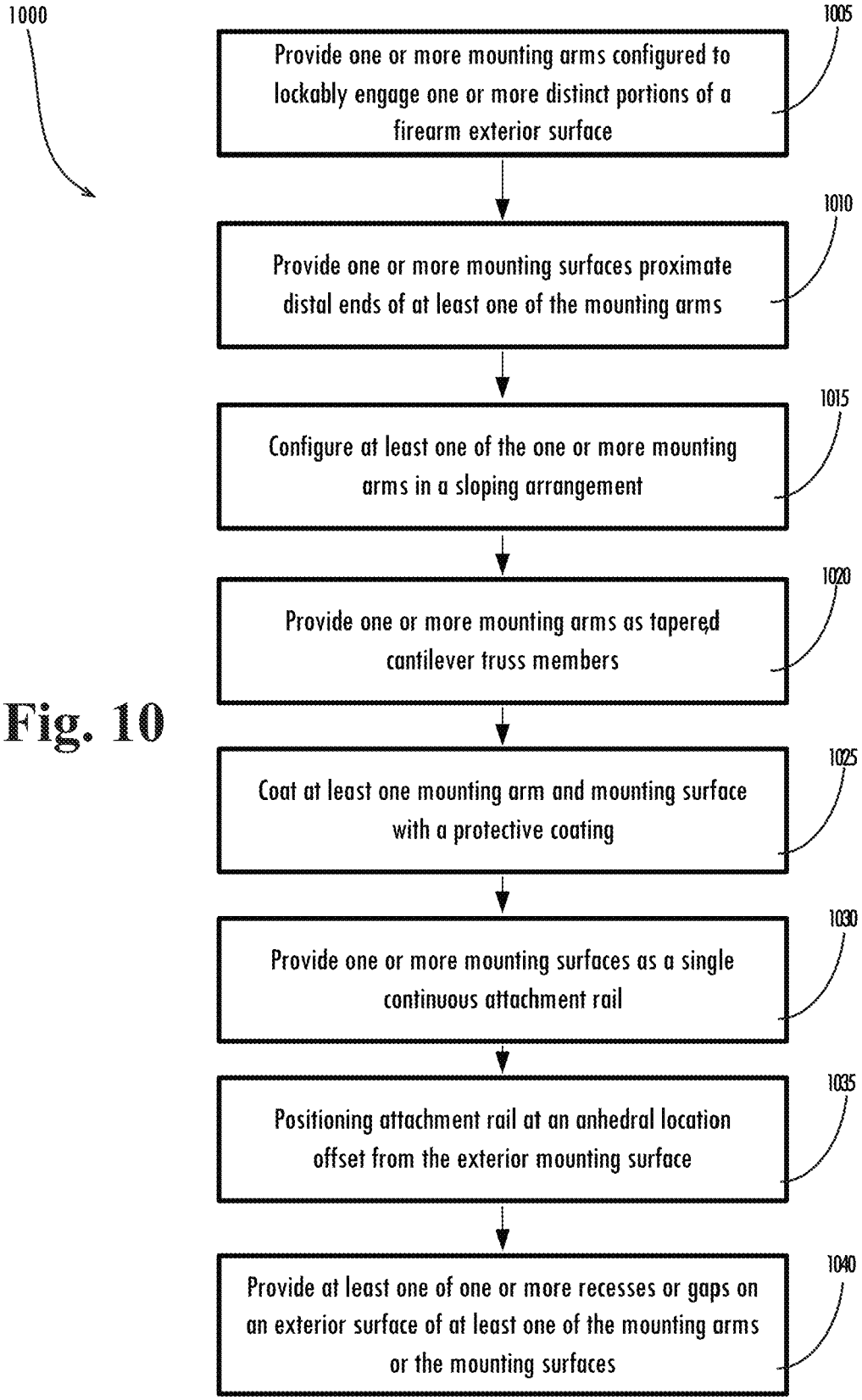
FIG. 10 illustrates a logical flow chart of a method of manufacturing and/or provision of a mounting bracket in accordance with some embodiments of the present invention.

FIG. 10 illustrates a logical flow chart of a method 1000 of constructing and/or provision of a mounting bracket in accordance with some embodiments of the present invention. It should be understood that method 1000 can include fewer actions than those illustrated and/or more actions than those illustrated. In similar fashion, it should be understood that method 1000 can be carried out in various orders so the illustrated sequence can be altered or modified as desired. Those skilled in the art will understand that the method 1000 is not the only method to manufacture embodiments of the present invention and that many fabrication variations fall within the scope of the claims.

Indeed, the various embodiments of the present invention may be manufactured using a number of methods with a number of various materials. Embodiments of the present invention may be manufactured from many high-strength, low-weight materials including, but not limited to, metal alloys, plastics and composite materials. In some embodiments of the present invention, mounting brackets can be manufactured from 7000 series aluminum alloy. This alloy is approximately 35% lighter than steel by volume yet provides a strength to weight ratio approximately double that of steel. It is also contemplated that other metals, metal alloys, plastics, and composite materials (e.g., carbon fiber) may also be used in the manufacture of the mounting brackets in accordance with various embodiments of the present invention.

Embodiments of the present invention can be machined from billet using Computer Numerically Controlled ("CNC") machining or other suitable machining processes, such as cast or forged using precision casting or forging methods. A sample CNC process may include one or more of the following actions. The below actions can be used to fabricate an integral component from a solid stock material. Other fabrication embodiments can also include fabricating a mounting bracket from several separately manufactured components.

- Obtain three dimensional solid geometry requirements from CAD file
- Generate CNC code for tool paths
- Run simulation to verify tool paths to determine if tool path geometry is correct; repeat code generation until simulation is verified
- Load material stock
- Machine material stock based on CAD file geometry
- Complete machining process to produce mounting bracket component
- Tumble and debur completed mounting bracket component
- Standardized finalized component and apply anodizing hardcoat Other fabrication embodiments can also include fabricating a mounting bracket from several components. The method 1000 can be a method to manufacture a detachable mounting bracket for carrying one or more firearm accessory devices. The method 1000 may be used to fabricate an integral bracket or a bracket comprising multiple parts assembled to form a mounting bracket. The method 1000 can initiate at 1005 and include providing one or more mounting arms. The mounting arms can be configured to lockably engage one or more distinct portions of a firearm exterior surface. For example, the mounting arms can be spaced apart such that the arms engage distinct portions of a Picatinny rail. The method 1000 can continue 1010 by providing one or more mounting surfaces proximate distal ends of at least one of the mounting arms. The mounting surfaces can be configured to carry one or more accessory devices. The distal ends of the mounting arms can be located away from ends of the mounting arms that can lockably engage portions of a firearm exterior surface. The method 1000 can also continue at 1015 to include configuring at least one of the mounting arms in a sloping arrangement. In such a configuration, distal ends of the mounting arms can have an anhedral (i.e., down sloping) location offset from the firearm exterior surface.

The method 1000 can also include various other features. For example, at 1020 the method can include providing or configuring the one or more mounting arms as tapered, cantilever truss members. Such configuration can provide structurally sound mounting arms. At 1025, the method 1000 can comprise coating at least one of the mounting arms and the mounting surfaces with a protective coating. The coating can be useful to protect mounting brackets from corrosive environments in addition to provide additional tactical uses. The method 1000 may also include at 1030 providing a detachably affixable securing mechanism. A detachably affixable securing mechanism can secure mounting arms to a firearm exterior surface. As a result, this enables mounting arms that are configured to be detachably affixed to the firearm exterior surface. Detachably affixable includes the ability to be attached and dis-attached in a rapid manner in some embodiments.

The method 1000 may also include other aspects in some embodiments of the present invention. For example, at 1035, the method 1000 can include providing one or more mounting surfaces as a single continuous attachment rail. The method 1000 may also include at 1040 positioning the attachment rail at an anhedral location offset from the exterior mounting surface. An anhedral location can position the attachment rail to the side of a weapons platform. The method 1000 can also include at 1045 providing at least one of one or more recesses or gaps on an exterior surface of at least one of the mounting arms or the mounting surfaces. Some embodiments of the method 1000 can include providing three mounting arms. The three mounting arms can to distribute loads and vibrations over at least a portion of an exterior firearm body surface. Also, in some embodiments, the method 1000 can include manufacturing the one or more mounting arms and the one or more mounting surfaces with an aluminum alloy.

The embodiments of the present invention are not limited to the particular formulations, process steps, and materials disclosed herein as such formulations, process steps, and materials may vary somewhat. Moreover, the terminology employed herein is used for describing exemplary embodiments only and the terminology is not intended to be limiting since the scope of the various embodiments of the present invention will be limited only by the appended claims and equivalents thereof.

Indeed, although some of the illustrated exemplary embodiments show embodiments of the present invention in a configuration for use with a M107 Barrett 0.50 BMG, other embodiments are contemplated for use on many other firearms and equipment that utilize Picatinny Rails to attach accessory devices. For instance, a mirror image would provide for right side mounting of accessories on a "left-handed" gun (i.e., a gun with the ejection port and bolt on the left side for left-handed shooters). Additionally, embodiments of the present invention can be used to add a bottom Picatinny rail to a weapon equipped with right, left, and top rails. In addition, embodiments of the present invention can be used with a wide array of weapons platforms, including various types of firearms.

Therefore, while embodiments of the invention are described with reference to exemplary embodiments, those skilled in the art will understand that variations and modifications can be effected within the scope of the invention as defined in the appended claims. Accordingly, the scope of the various embodiments of the present invention should not be limited to the above discussed embodiments, and should only be defined by the following claims and all equivalents.

We claim:

1. A mounting bracket to provide a mounting surface to carry a firearm accessory device, the mounting bracket comprising:

an elongated attachment member comprising at least a portion along its length a rail attachment surface configured to carry one or more accessory devices parallel to a barrel of a firearm;

two or more securing mechanisms disposed on opposing ends of the mounting bracket, the two or more securing mechanisms each comprising a clamp member and a securedly detachable tension member, set off from the elongated attachment member, the two or more securing mechanisms configured to be securedly attachable to an accessory rail attached to an exterior firearm surface other than the barrel; and a plurality of transverse members extending away from and connecting the elongated attachment member to the two or more securing mechanisms, the plurality of transverse members comprising:

a first transverse member extending diagonally from one end of the elongated attachment member;

a second transverse member extending diagonally from another end of the elongated attachment member, such that the first and second transverse members are disposed at a non-parallel angle; and a third transverse member disposed co-planar between the first and second transverse members and extending generally perpendicular from a central portion of the elongated attachment member;

wherein the elongated attachment member has a length less than a length formed between two opposing-end securing mechanisms.

2. The mounting bracket of claim 1, wherein the securedly detachable tension member is disposed through, and proximate to, a first end of the clamp member, the clamp member and the securedly detachable tension member configured to be securedly attachable to the accessory rail disposed on the exterior firearm surface.

3. The mounting bracket of claim 1, the first ends of the plurality of transverse members being spaced apart from each other such that the plurality of transverse members are configured to attach to the two or more securing mechanisms disposed at different positions along the firearm accessory rail.

4. The mounting bracket of claim 1, the plurality of transverse members shaped in a generally anhedral configuration such that a longitudinal axis of the elongated attachment member is parallel to, but offset from, a longitudinal axis formed by the two or more securing mechanisms.

5. The mounting bracket of claim 1, wherein the elongated attachment member, the two or more securing mechanisms, and the plurality of transverse members form an integral bracket component.

6. The mounting bracket of claim 1, the elongated attachment member being generally positioned parallel to a bore axis of a firearm.

7. The mounting bracket of claim 1, wherein the elongated attachment member is configured to carry one or more accessory devices in a parallel arrangement relative to a bore axis of a firearm.

8. A detachable mounting bracket for mounting on a firearm with a first Picatinny or Weaver rail, the mounting bracket comprising:

a plurality of spaced apart arms, curved along at least a portion of the arm, each arm comprising a first end and a second end, the plurality of spaced apart arms comprising:

first and second mounting arms comprising inwardly curved portions, such that the first and second mounting arms generally converge from the first end to the second end: and a third mounting arm disposed equidistant between the first and second mounting arms;

a plurality of securing mechanisms disposed on the first end of each of the plurality of spaced apart mounting arms for detachably securing the mounting bracket to the first Picatinny or Weaver rail of the firearm, the securing mechanisms defining a first plane, each securing mechanism comprising:

a first mounting surface integral to the first end of each respective arm of the plurality of spaced apart arms;

a mounting plate comprising a second mounting surface; and a fastener for detachably securing the mounting plate to the mounting bracket;

an accessory mounting surface connecting the second ends of the plurality of spaced apart mounting arms and defining a second plane;

wherein a longitudinal axis of the first plane and the second plane are parallel;

wherein a lateral axis of the first plane and the second plane are perpendicular and at different heights.

9. The mounting bracket of claim 8, further comprising a second Picatinny or Weaver rail detachably coupled to the accessory mounting surface.

10. The mounting bracket of claim 9, wherein the second Picatinny or Weaver rail is disposed in parallel alignment with the firearm rifle bore.

11. The mounting bracket of claim 8, wherein the first mounting surface, the plurality of spaced apart arms, and the accessory mounting surface are integral.

12. The mounting bracket of claim 9, wherein the first mounting surface, the plurality of spaced apart arms, the accessory mounting surface, and the second Picatinny or Weaver rail are integral.

13. The mounting bracket of claim 9, wherein each of the plurality of spaced apart arms are detachably secured to distinct and separate portions of the first Picatinny or Weaver rail.

14. The mounting bracket of claim 8, wherein the first and second mounting arms are disposed at equal and opposite angles; and the third mounting arm bisects the angled formed between the first and second mounting arms.

15. The mounting bracket of claim 14, wherein the third mounting arm is disposed perpendicular to the first Picatinny or Weaver rail.

16. A tri-forked, detachable mounting bracket for mounting on a firearm with a first Picatinny or Weaver accessory rail, the mounting bracket comprising:

a first mounting arm, comprising a first end proximate the first Picatinny or Weaver accessory rail and a second end, disposed at a first, non-perpendicular angle to the first Picatinny or Weaver rail accessory rail;

a second mounting arm, comprising a first end proximate the first Picatinny or Weaver accessory rail and a second end, disposed at a second, equivalent, opposite angle to the first mounting arm such that the first mounting arm and the second arm converge from the first ends to the second ends;

a third mounting arm disposed perpendicular to the first Picatinny or Weaver rail and bisecting the angle formed between the first mounting arm and the second mounting arm;

a plurality of securing mechanisms disposed on the first end of each of the plurality of spaced apart mounting arms for detachably securing the mounting bracket to the first Picatinny or Weaver rail of the firearm, the securing mechanisms defining a first plane, each securing mechanism comprising:

a first mounting surface integral to the first end of each respective arm of the plurality of spaced apart arms;

a mounting plate comprising a second mounting surface; and a fastener for detachably securing the mounting plate to the mounting bracket; and an accessory mounting surface spanning and connecting the second ends of the first, second, and third mounting arms.

17. The mounting bracket of claim 16, wherein the accessory mounting surface, the plurality of mounting arms, and the first mounting surfaces are disposed on a first side of the first Picatinny or Weaver accessory rail; and the mounting plate is disposed on a second side of the first Picatinny or Weaver accessory rail.

18. The mounting bracket of claim 16, wherein the first, second, and third mounting arms curve along at least a portion and turn through approximately 90 degrees.

19. The mounting bracket of claim 16, wherein the first, second, and third mounting arms are sized and shaped to substantially conform to the shape of one or more of a receiver and a forend of the firearm.

20. The mounting bracket of claim 16, wherein the first, second, and third mounting arms further define recesses disposed on a back side of the mounting arms for reducing the weight of the bracket, enhancing strength, and providing vibration dampening.

21. The mounting bracket of claim 16, wherein the accessory mounting surface comprises a second Picatinny or Weaver rail.

22. The mounting bracket of claim 21, wherein the second Picatinny or Weaver rail is disposed in parallel alignment with the rifle bore of the firearm ("co-bore aligned").

23. The mounting bracket of claim 21, wherein the first and second Picatinny or Weaver rails are longitudinally parallel and laterally perpendicular.

24. A tri-forked, detachable mounting bracket for mounting on a firearm with a first Picatinny or Weaver accessory rail, the mounting bracket comprising:

a mounting arm assembly consisting of:

a first mounting arm, comprising a first end proximate the first Picatinny or Weaver accessory rail and a second end disposed at a first, non-perpendicular angle to the first Picatinny or Weaver rail;

a second mounting arm, comprising a first end proximate the first Picatinny or Weaver accessory rail and a second end disposed at a second, equivalent but opposite angle to the first mounting arm such that the first mounting arm and the second arm generally converge from the first ends to the second ends;

a third mounting arm disposed perpendicular to the first Picatinny or Weaver rail and bisecting the angle formed between the first mounting arm and the second mounting arm;

a plurality of securing mechanisms disposed on the first end of each of the plurality of spaced apart mounting arms for detachably securing the mounting bracket to the first Picatinny or Weaver rail of the firearm, the securing mechanisms defining a first plane, each securing mechanism comprising:

a first mounting surface integral to the first end of each respective arm of the plurality of spaced apart arms;

a mounting plate comprising a second mounting surface;

a fastener disposed through the first end of each respective arm; and a retainer for detachably coupling each mounting plate to the fastener; and a second Picatinny or Weaver rail spanning and connecting the second ends of the first, second, and third mounting arms.

25. The mounting bracket of claim 24, wherein the mounting arm assembly is sized and shaped to substantially conform to one or more of a receiver or a forend of the firearm.

26. The mounting bracket of claim 24, wherein the mounting arm assembly, first mounting surfaces, and second Picatinny or Weaver rail are disposed on a first side of the first Picatinny or Weaver rail; and the mounting plate and the retainer are disposed on a second side of the first Picatinny or Weaver rail.

27. The mounting bracket of claim 24, wherein the first Picatinny or Weaver rail and the second Picatinny or Weaver rail define orthogonal planes.

* * * * *